US007839348B2

(12) United States Patent
Baker

(10) Patent No.: US 7,839,348 B2
(45) Date of Patent: Nov. 23, 2010

(54) AUTOMATIC SATELLITE TRACKING SYSTEM

(76) Inventor: Gary Baker, 12503 E. 26th St., Spokane, WA (US) 99216

( * ) Notice: Subject to any disclaimer, the term of this patent is extended or adjusted under 35 U.S.C. 154(b) by 159 days.

(21) Appl. No.: 12/131,929

(22) Filed: Jun. 3, 2008

(65) Prior Publication Data

US 2009/0295654 A1 Dec. 3, 2009

(51) Int. Cl.
*H01Q 3/00* (2006.01)
*H01Q 1/32* (2006.01)
*H01Q 3/02* (2006.01)

(52) U.S. Cl. ..... 343/757; 343/711; 343/713; 343/882

(58) Field of Classification Search ..... 343/711, 343/712, 713, 757, 763, 765, 766, 878, 880, 343/882
See application file for complete search history.

(56) References Cited

U.S. PATENT DOCUMENTS 5,337,062 A * 8/1994 Sherwood et al. ..... 343/711
6,864,846 B2 * 3/2005 King ..... 343/757
6,937,199 B2 * 8/2005 King ..... 343/757
7,230,581 B2 * 6/2007 McEwan ..... 343/882

* cited by examiner

*Primary Examiner*—Hoang V Nguyen

(57) ABSTRACT

A satellite tracking system for tracking a synchronous satellite includes a satellite antenna system movably supported on a roof of a vehicle via a roof frame to move between an operation position and a folded position. At the operation position, the satellite antenna system is rotated on the roof frame to adjust a horizontal orientation of a parabolic reflector of the satellite antenna system while the parabolic reflector is pivotally lift at a predetermined inclination angle to align with the satellite. At the folded position, the parabolic reflector is pivotally dropped down until the parabolic reflector faces downwardly to the roof of the vehicle to conceal a signal transmitting device of the satellite antenna system between the parabolic reflector and the roof of the vehicle. Therefore, the satellite antenna system provides a relatively low profile at the folded position when the vehicle travels.

19 Claims, 10 Drawing Sheets

AUTOMATIC SATELLITE TRACKING SYSTEM

BACKGROUND

1. Field of the Invention

The present invention relates to a satellite dish antenna. More particularly, an automatic satellite tracking system comprises a satellite antenna system which is adapted to be easily mounted on a roof of a vehicle with no cables penetrating the roof and adapted to automatically fold flat on the roof for providing a relatively low profile at a folded position when the vehicle travels.

2. Discussion of the Related Art

Satellite dish antennas are considered as one of popular communication devices. These antennas are typically installed on a fixed surface, such as a roof or a wall surface of a building, to receive the satellite signal such as TV broadcasting signal, to receive and transmit an Internet signal to the satellite. Generally speaking, the internet satellite dish antenna comprises a transmitting-receiving dish being set to align with the satellite for signal communications. Since the satellite dish antenna is a highly directional antenna, the satellite dish antenna must be stationary secured at a fixed location to precisely aim the dish at the direction of the satellite. Polarization (skew) of the transmitted signal must be precise in order to not cause interference to the opposite polarized transponder within the satellite.

The satellite dish antennas have become popular in recent years primarily for use in vehicle communication systems. Accordingly, the satellite dish antenna further comprises a roof mount to install the dish on the roof of the vehicle, such as recreational vehicle, truck, or mobile home. However, such mobile satellite dish antenna have several drawbacks.

As it is mentioned above, since the satellite dish antenna is a highly directional antenna, the dish must be manually adjusted its orientation when the vehicle travels from place to place. The tuning process requires the user to manually elevate, lower, and position the dish to the direction of the satellite, wherein the alignment of the dish is somewhat difficult due to the manual adjustment and usually resulted in low quality signal reception and possible satellite interference. Furthermore, the dish may be unintentionally shifted its orientation misalign with the direction satellite in a high wind operating environment.

The dish will be damaged during travel. Since the dish is deployed on the roof of the vehicle, it would be exposed to road wind and direct impact form road debris. Even though the dish can be collapsed on the roof of the vehicle, the overall collapsed size of the satellite dish antenna would not provide a low profile during travel.

The mobile satellite dish antennas are costly to manufacture, install, and maintain. Accordingly, the manufacture of the receiving dish itself is somewhat inexpensive. However, the roof mount, especially incorporating with a collapsible structure, will highly increase the cost of the satellite dish antenna. In addition, the installation of the satellite dish antenna is time consuming and requires an experienced technician to drill holes in the roof of the vehicle for electrical wiring.

BRIEF SUMMARY OF THE INVENTION

It is a primary object of the present invention to solve the needs set forth above by providing an automatic satellite tracking system which comprises a collapsible roof frame to fold a satellite antenna system between an operation position and a folded position. Accordingly, the satellite antenna system provides a very low profile for high wind operating environment when it is deployed at the operation position for preventing the satellite antenna system from being direct impact by road wind and road debris. The satellite antenna system also provides a very low profile at the folded position during coach transit down the highway.

More specifically, the roof frame comprises a roof mount, a rotational frame rotatably mounted thereon, and a supporting frame for supporting the satellite antenna system. At the operation position, the rotational frame is rotated on the mounting base to adjust a horizontal orientation of the parabolic reflector above the mounting base. The supporting frame is pivotally moved to lift up the parabolic reflector at a predetermined inclination angle until the parabolic reflector aligns with the satellite. At the folded position, the supporting frame is pivotally moved away from the mounting base to drop down the parabolic reflector until the parabolic reflector faces downwardly to the roof of the vehicle to conceal the signal transmitting/receiving device between the parabolic reflector and the roof of said vehicle. Therefore, the satellite antenna system provides a relatively low profile at the folded position during the vehicle travels.

Another object of the present invention is to provide a driving mechanism for automatically operating the satellite antenna system between the operation position and the folded position. The satellite antenna system is full-automatically powered by the driving mechanism to be deployed to adjust the horizontal orientation of the satellite antenna system and the inclination of the satellite antenna system for optimizing the signal reception. The satellite antenna system is also driven by the driving mechanism to be collapsed at its folded position. In particularly, the driving mechanism is wirelessly controlled by the user so that the user does not need to climb up to the roof of the vehicle in order to operate the driving mechanism.

Another object of the present invention is to provide an automatic satellite tracker for automatically targeting the satellite antenna system to the satellite. Therefore, the alignment of the satellite antenna system is automatically adjusted to the direction of the satellite so that no manual adjustment is involved.

Another object of the present invention is to provide a cable-free power transferring structure, wherein the driving mechanism is power-transferred via a slip ring assembly in the roof frame so that the satellite antenna system can be continuously rotated on the roof frame, i.e. more than 360 degrees revolution, for tracking the satellite. Therefore, no wire is twisted during the revolution of the satellite antenna system.

Another object of the present invention is that all the electronic components of the satellite tracking system are concealed in a compartment in the rotational frame to simplify the installation of the present invention. Accordingly, the installation can be done by the user within an hour or so.

Another object of the present invention is to provide a hole-free installation structure, wherein the roof frame is installed onto the roof of the vehicle without requiring any roof penetration for electrical cable connection. For example, when the automatic satellite tracking system of the present invention is installed on the roof of the recreational vehicle, the power cable runs from the slip ring assembly at the roof frame to the power source of the recreational vehicle through typically the refrigerator vent on the roof of the recreation vehicle.

Another object of the present invention is to provide a skew adjustment for skewing the signal coming out of the waveguide feed assembly so as to minimize the cross pole signal at the satellite. Accordingly, the skew adjuster is arranged to rotate the parabolic dish and also the waveguide assembly for final skew (cross pole) adjustment.

Another object of the present invention is to provide an Internet communication unit for transmitting & receiving Internet signal via "WiFi". Therefore, the user is able to wirelessly receive and send Internet signal through the satellite antenna system. More importantly, no cable is required for wiring the satellite antenna system to the interior of the vehicle for Internet connection.

For a more complete understanding of the present invention with its objectives and distinctive features and advantages, reference is now made to the following specification and to the accompanying drawings.

BRIEF DESCRIPTION OF THE DRAWING(S)

DETAILED DESCRIPTION OF THE INVENTION

Figure 1:
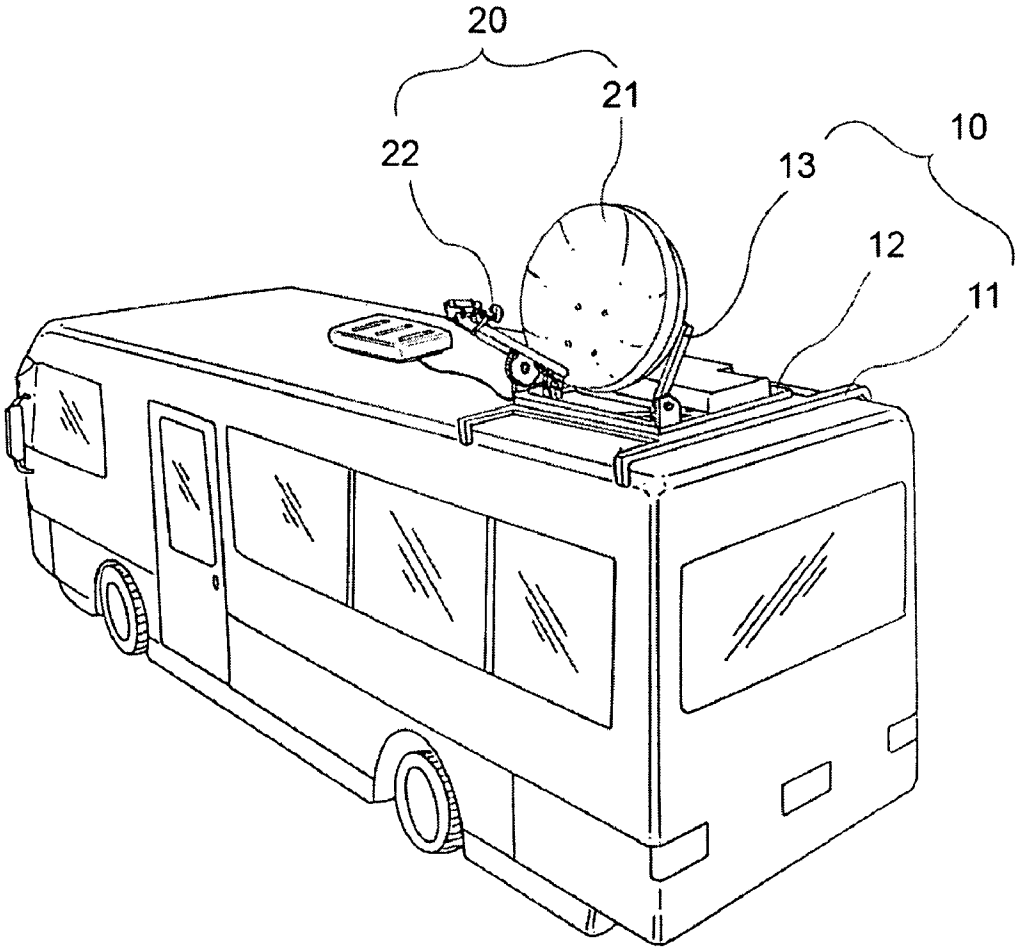
FIG. 1 is a perspective view illustrating an automatic satellite tracking system mounting on a roof of a recreational vehicle in accordance with the present invention.
Figure 2:
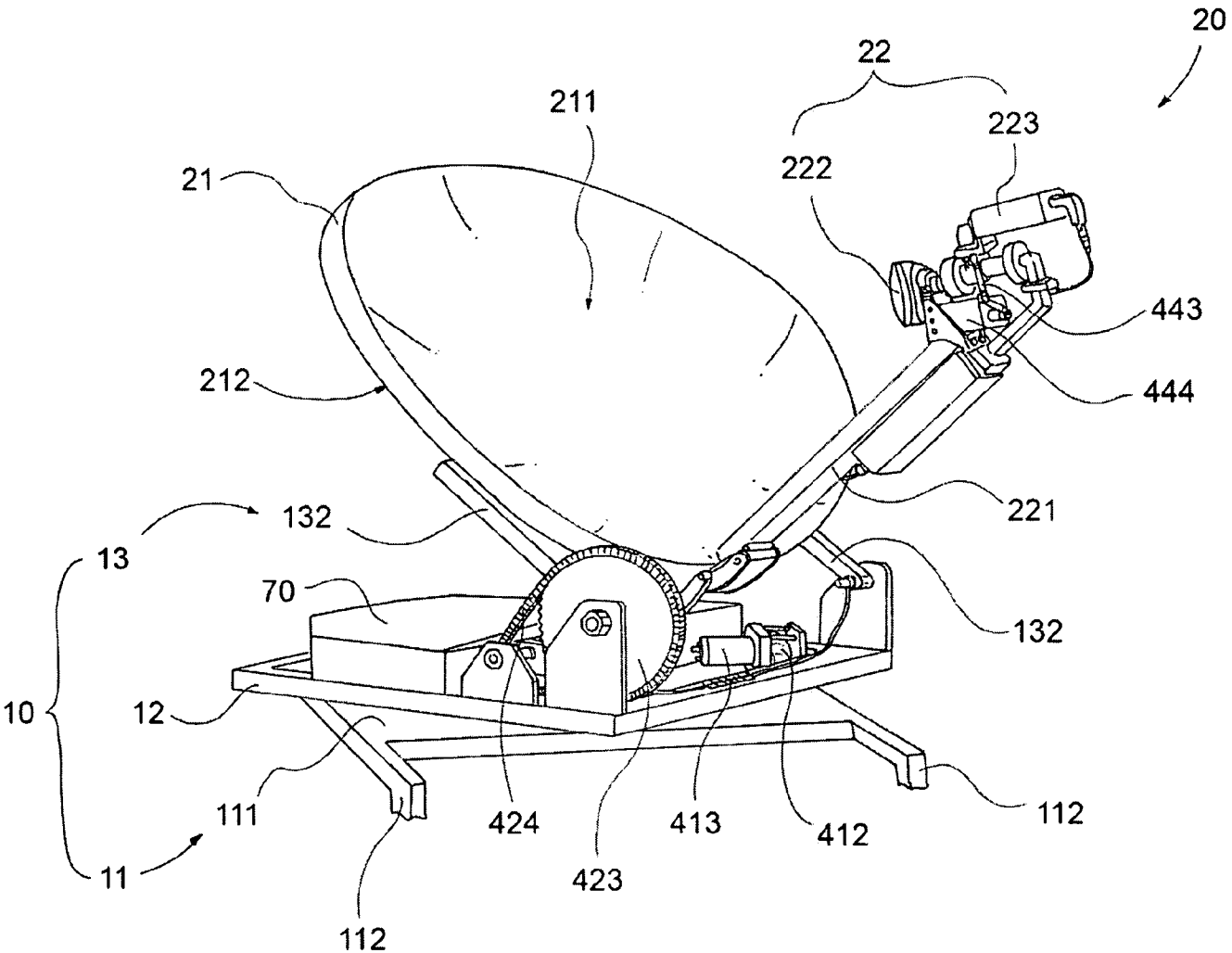
FIG. 2 is a perspective view of the automatic satellite tracking system in accordance with the present invention.

Referring to FIGS. 1 and 2 of the drawings, an automatic satellite tracking system in accordance with the present invention is illustrated for incorporating with a vehicle to track a geo-synchronous satellite. For simple representation and easy understanding, the automatic satellite tracking system of the present invention is mounted on a roof of a recreational vehicle as an example. The automatic satellite tracking system comprises a roof frame 10 and a satellite antenna system 20.

The roof frame 10 comprises a mounting base 11 adapted for securely mounting on the roof of the vehicle, a rotational frame 12 supported on the mounting base 11 in an infinite rotational movement in which the rotational frame 12 is adapted to be 360° rotated on the mounting base, and a supporting frame 13 pivotally coupled with a pivot edge 121 of the rotational frame 12.

The satellite antenna system 20 comprises a parabolic reflector 21 securely coupled with the supporting frame 13 for gathering satellite signal and reflecting the satellite signal to a feed horn of the parabolic reflector 21, and a feedhorn device 22 pivotally extended to the feed horn of the parabolic reflector 21.

The parabolic reflector 21 is a dish-shaped receiving antenna that collects and focuses an incoming transmission signal by the satellite, wherein the parabolic reflector 21 has a concave reflection side 211 and an opposed convex mounting side 212. The supporting frame 13 is coupled at the convex mounting side 212 of the parabolic reflector 21.

As shown in FIG. 7, the feedhorn device 22 comprises a pivot arm 221 pivotally extended from the parabolic reflector 21, a feed horn assembly 222 coupling with a free end of said pivot arm 221, and a skew adjuster 223 communicatively linked to the feed horn assembly 222. Accordingly, the feed horn assembly 222 comprises a LNB (Low Noise Block Down Converter) as a receiving system for receiving signals, and an ODU (outdoor unit) as a transmitting system for transmitting signals. Both transmitting and receiving signals are focused through the feed horn assembly which is skew adjusted by the skew adjuster 223.

Figure 3A:
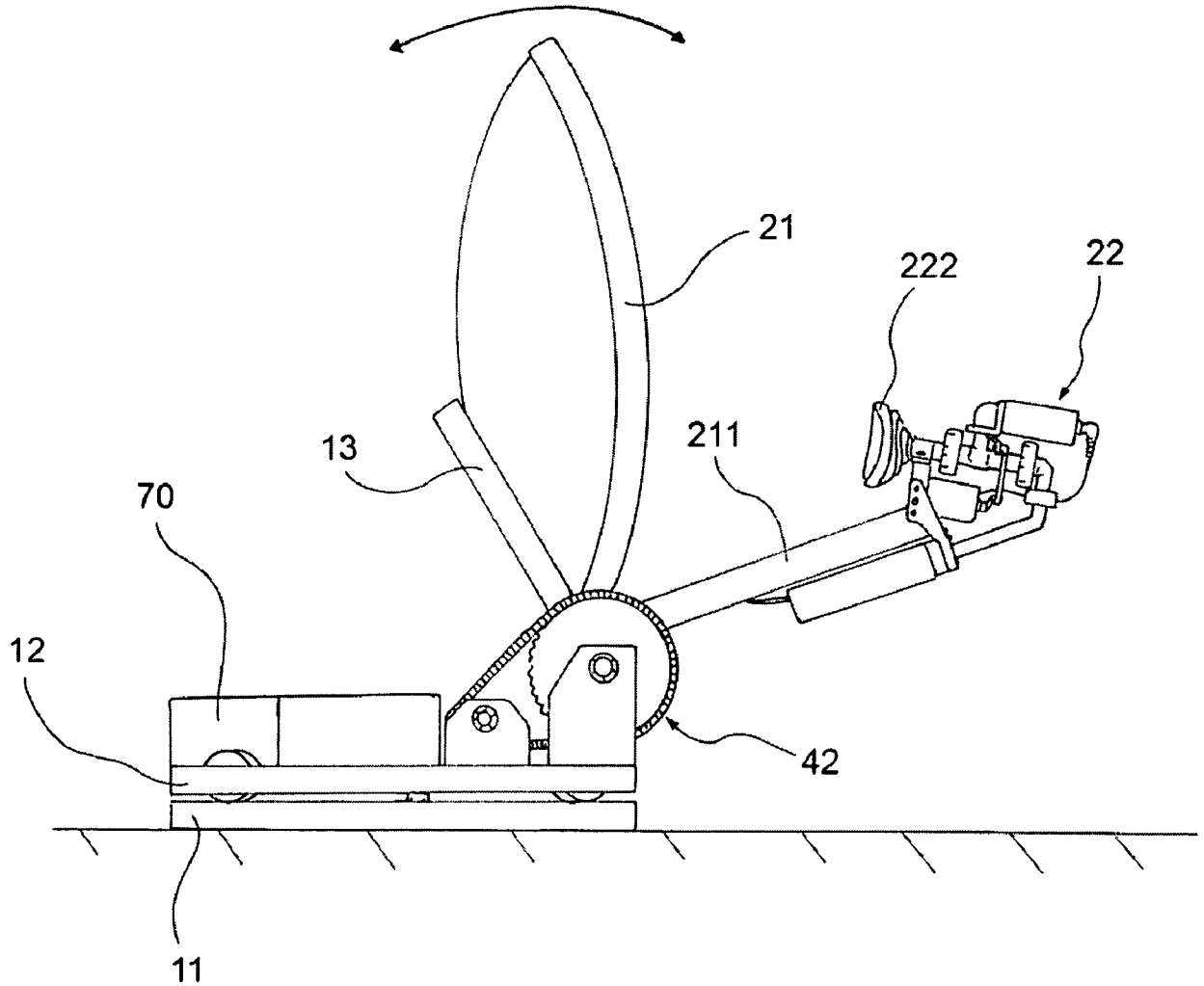
FIGS. 3A and 3B illustrate the automatic satellite tracking system being moved between the operation position and the folded position in accordance with the present invention.
Figure 3B:
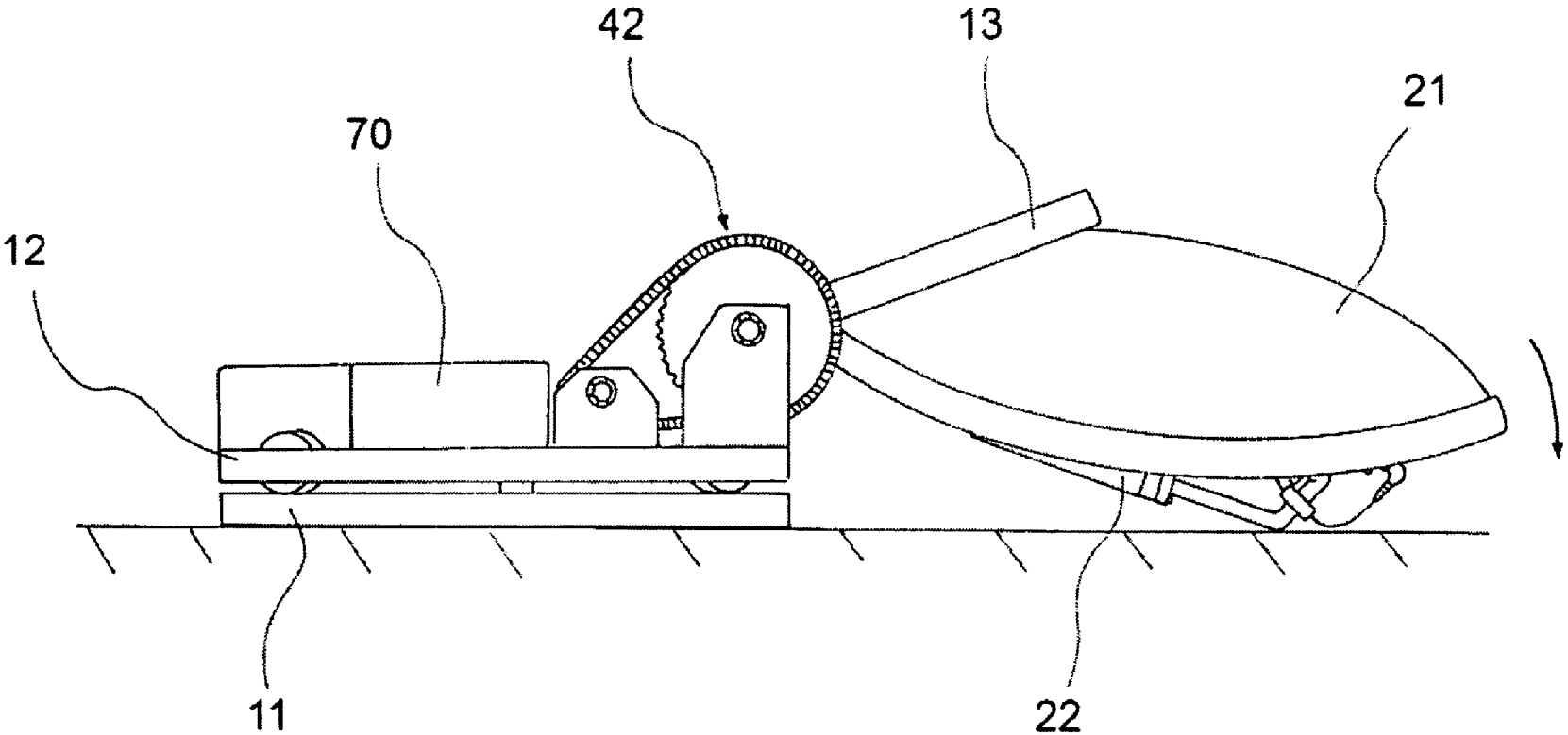

Accordingly, the satellite antenna system 20 is adapted for being folded between an operation position and a folded position. At the operation position as shown in FIG. 3A, the rotational frame 12 is rotated on the mounting base 11 to adjust a horizontal orientation of the parabolic reflector 21 above the mounting base 11, wherein the supporting frame 13 is pivotally moved to lift up the parabolic reflector 21 at a predetermined inclination angle until the concave reflection side 211 of the parabolic reflector 21 aligns with the satellite for receiving the satellite signal. At the folded position as shown in FIG. 3B, the rotational frame 12 is rotated on the mounting base 11 to adjust the horizontal orientation of the parabolic reflector 21 away from the mounting base 11, wherein the supporting frame 13 is pivotally moved away from the mounting base 11 to drop down the parabolic reflector 21 until the concave reflection side 211 of the parabolic reflector 21 faces downwardly to the roof of the vehicle to conceal the signal transmitting device 22 between the parabolic reflector 21 and the roof of the vehicle, such that the satellite antenna system provides a relatively low profile at the folded position when the vehicle travels.

It is worth mentioning that the conventional satellite antenna system provides a collapsible structure of the dish, wherein the dish is folded up at a position that the concave surface of the dish faces towards the roof mount. Because of the distance between the roof mount and the roof of the vehicle, the conventional satellite antenna system cannot provide a low profile of the collapsed dish. In other words, the collapsed dish cannot be directly folded down to the roof of the vehicle. The present invention provides a very low profile of the parabolic reflector 21 at the folded position because the parabolic reflector 21 is pivotally folded down at a position that the concave reflection side 211 of the parabolic reflector 21 faces downwardly to the roof of the vehicle to minimize the distance between the roof frame 10 and the roof of the vehicle.

According to the preferred embodiment, the mounting base 11 has a running platform 111 for the rotational frame 12 rotating thereon and comprises a plurality of clipping arms 112 sidewardly extended from the running platform 111 for securely mounting at the peripheral of the roof of the vehicle without any roof penetration. For recreational vehicles, there are four tab adapters at the clipping arms 112 bolted to the coach roof. On SUV's, two adapter support assemblies fabricated from aluminum made clipping arms 112 are used to secure the system on the roof.

The rotational frame 12 is overlapped on the mounting base 11, wherein when the rotational frame 12 is rotated on the mounting base 11, the satellite antenna system 20 is correspondingly rotated to adjust the horizontal orientation of the parabolic reflector 21. In other words, the rotational frame 12 is embodied as a turntable to rotate the satellite antenna system 20.

The supporting frame 13 generally forms in a U-shaped structure having a longitudinal support 131 coupling with the convex mounting side 212 of the parabolic reflector 21 and two transverse arms 132 pivotally coupling with the rotational frame 12.

The automatic satellite tracking system further comprises an automatic driving mechanism 40 for automatically operating the satellite antenna system 20 between the operation position and the folded position. The automatic driving mechanism 40 comprises a horizontal driving unit 41, a vertical driving unit 42, and a control module 43.

Figure 4:
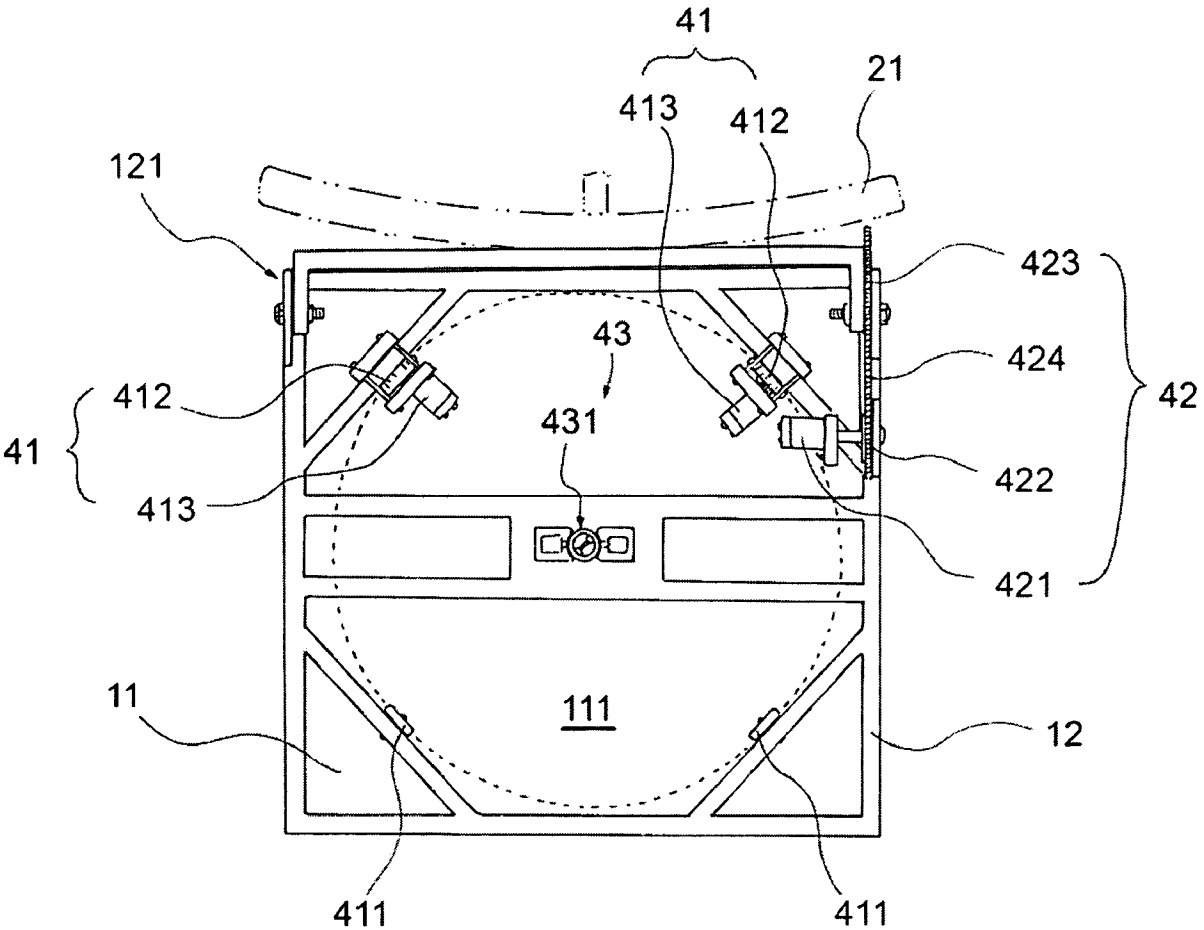
FIG. 4 is a perspective view of the horizontal driving unit of the automatic satellite tracking system in accordance with the present invention.

The horizontal driving unit 41 is arranged for driving the rotational frame 12 to be rotated on the mounting base 11 to controllably adjust the horizontal orientation of the parabolic reflector 21 in responsive to the direction of the satellite. The horizontal driving unit 41 comprises a plurality of supporting wheels 411 spacedly mounted at the rotational frame 12 to run on the running platform 111 of the mounting base 11 as shown in FIG. 4. It is worth mentioning that the supporting wheels 411 can directly run on the roof of the vehicle that the running platform 111 forms at the roof of the vehicle.

The horizontal driving unit 41 further comprises one or more horizontal servos 413 operatively connected to the rotational frame 12 to drive the rotational frame 12 being 360° rotated on the mounting base 11. Accordingly, the horizontal servo 413, which is a direct drive horizontal servo, is operatively coupled with one of the supporting wheels 411 to drive the corresponding supporting wheel 411 to rotationally turn the rotational frame 12 on the mounting base 11 so as to controllably adjust the horizontal orientation of the parabolic reflector 21. In particularly, the horizontal servo 413 is coupled with the corresponding supporting wheel 411 at a position close to the pivot edge 121 of the rotational frame 12. In other words, the supporting wheel 411 which is driven by the horizontal servo 413 becomes a driving wheel to turn the rotational frame 12 on the running platform 111 of the mounting base 11.

The supporting wheels 411 run on the running platform 111 of the mounting base 11 in a circular path. The horizontal servo 413 is actuated to drive the one supporting wheels 411 to rotate, the rest of the supporting wheels 411 are driven to rotate on the running platform 111 of the mounting base 11. Accordingly, the supporting wheels 411 are evenly positioned at a peripheral edge of the rotational frame 12 so that the rotational frame 12 can be turned on the mounting base 11 in a stable manner.

In addition, the driving wheel (i.e. the supporting wheel 411 coupled with the horizontal servo 413) is positioned at the pivot edge 121 of the rotational frame 12. When the parabolic reflector 21 is pivotally lifted up at the pivot edge 121 of the rotational frame 12 via the supporting frame 13 at the inclination angle, the weight of the parabolic reflector 21 at the pivot edge 121 of the rotational frame 12 is heavier than that of the parabolic reflector 21 at the opposed edge of the rotational frame 12. Therefore, the horizontal servo 413 will drive the driving wheels to rotate to ensure the rotational frame 12 being turned on the mounting base 11 in a stable manner.

Figure 5:
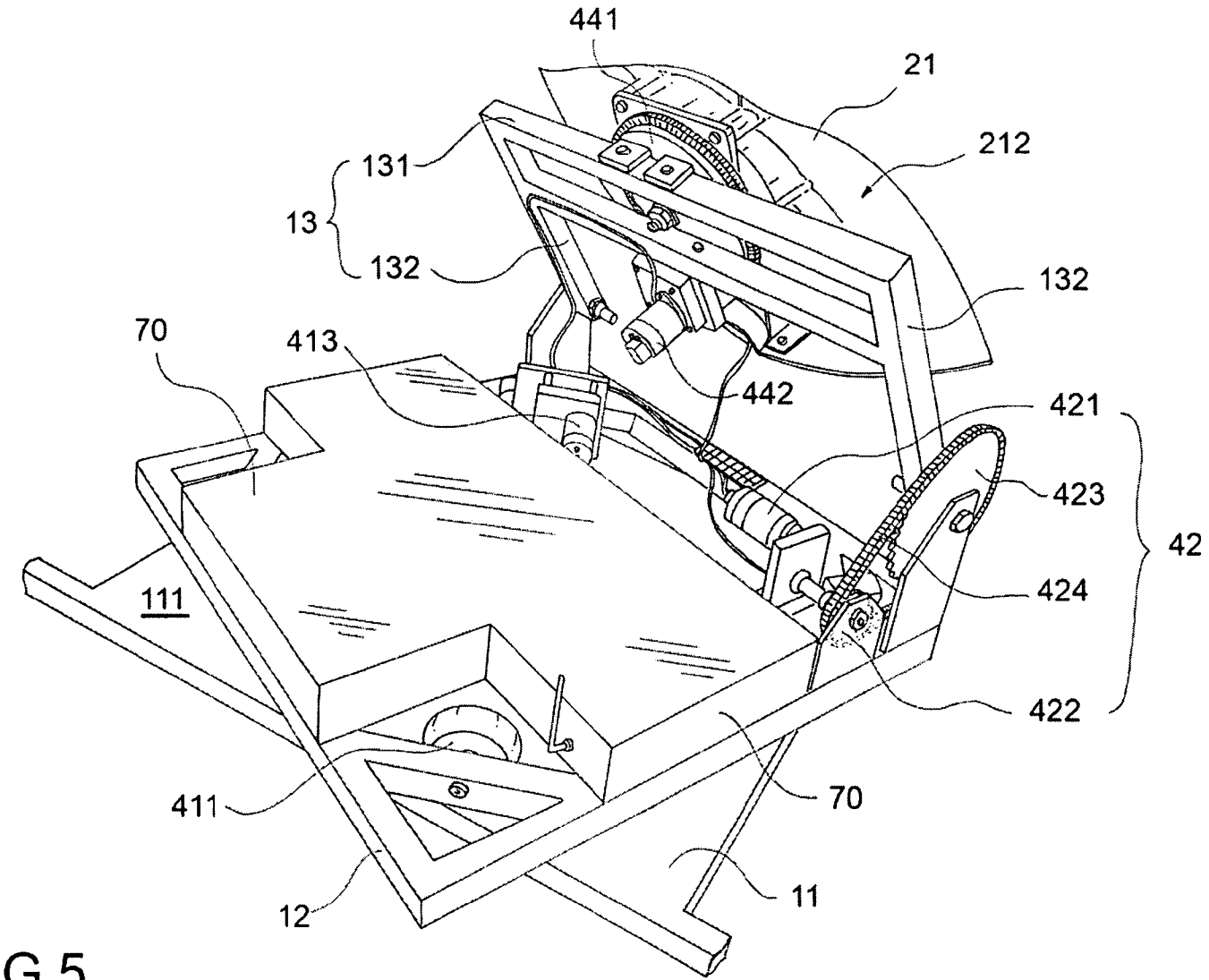
FIG. 5 is a perspective view of the vertical driving unit of the automatic satellite tracking system in accordance with the present invention.

The vertical driving unit 42 is pivotally driving the supporting frame 13 to controllably adjust the inclination angle of the parabolic reflector 21 in responsive to the direction of the satellite. As shown in FIG. 5, the vertical driving unit 42 comprises a gear-chain assembly coupling between the rotational frame 12 and the supporting frame 13, and a vertical servo 421 driving the supporting frame 13 to pivotally move through the gear-chain assembly.

Accordingly, the gear-chain assembly comprises a first sprocket 422 coupling with the rotational frame 12 and being driven to rotate by the vertical servo 421, a second sprocket 423 coupling with the supporting frame 13, and an endless transmission chain 424 coupling between the first and second sprockets 422, 423 in such a manner that when the first sprocket 422 is rotated, the second sprocket 423 is driven to rotate through the endless transmission chain 424 to pivotally move the supporting frame 13 for adjusting the inclination angle of the parabolic reflector 21. As shown in FIG. 5, the output shaft of the vertical servo 421 is coupled with the first sprocket 422 to drive the first sprocket 422 to rotate. A diameter of the first sprocket 422 is smaller than that of the second sprocket 423.

Figure 8:
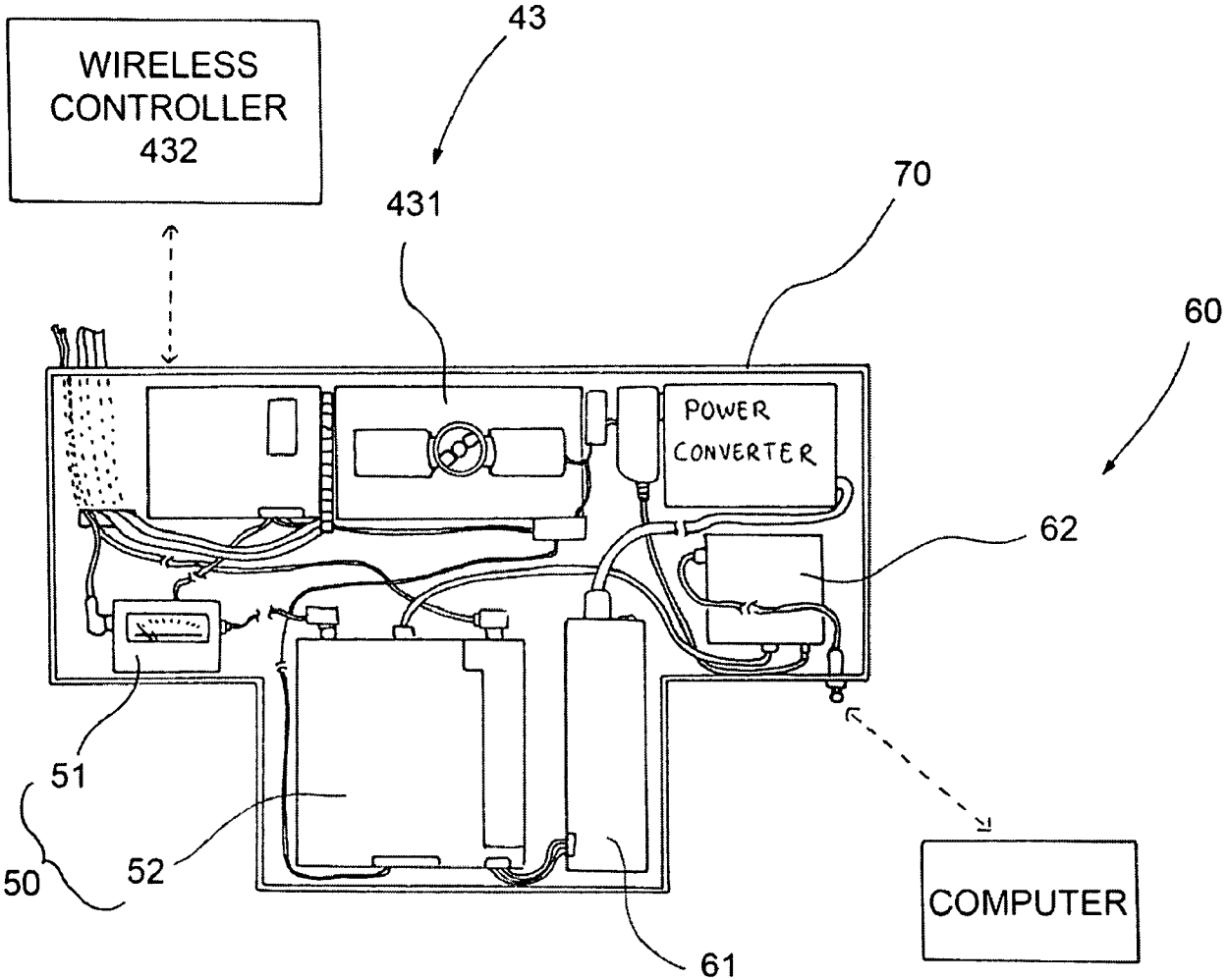
FIG. 8 is a top view of the electronic enclosure on the roof frame of the automatic satellite tracking system in accordance with the present invention.

The control module 43 is operatively linked to the horizontal and vertical driving units 41, 42 to automatically move the satellite antenna system 20 between the operation position and the folded position. As shown in FIGS. 4 and 8, the control module 43 comprises a slip ring assembly 431 electrically coupling with the power source of the vehicle, a control board 433 electrically connected with the horizontal and vertical driving units 41, 42 via control cables, and a wireless controller 432 wirelessly communicating with the control board 433 to operatively move the satellite antenna system 20 between the operation position and the folded position in a wireless controlling manner.

Accordingly, the horizontal and vertical driving units 41, 42 are connected via control cables to the control board 433 wherein the wireless controller 432 is wirelessly linked to the control board 433 to initiate deployment and system storage.

The slip ring assembly 431 is extended from the mounting base 11 to the rotational frame 12 for power transmission. An electric cable runs from the slip ring assembly 431 and under the mounting base 11, wherein the electric cable is then electrically connected to the power source of the vehicle through the refrigerator vent at the roof of the vehicle so that the electrical installation of the present invention does not require any hole drilling on the roof of the vehicle, as shown in FIG. 1. In other words, no roof penetration is required to run the electric cable. The electric cable is electrically connected to a 12V power source of the vehicle. Accordingly, having the slip ring assembly 431 for power transmission, the rotational frame 12 can be 360° rotated on the mounting base 11 in a wire-free connection.

It is worth mentioning that the present invention provides a cable-free power transferring structure for the horizontal and vertical driving units 41, 42, wherein the driving mechanism 40 is power-transferred via the slip ring assembly 431 so that the satellite antenna system 20 can be continuously rotated on the roof frame 10, i.e. more than 360 degrees revolution, for tracking the satellite. Therefore, no wire is twisted during the revolution of the satellite antenna system 20.

The wireless controller 432, according to the preferred embodiment, is a RF link remote control, wherein the wireless controller 432 is wirelessly linked, through the RF frequency, to the control board 433 which is connected to the horizontal and vertical driving units 41, 42. The wireless controller 432 is adapted to activate the control board 433 to automatically actuate the horizontal and vertical driving units 41, 42. In other words, once the control board 433 is activated by the wireless controller 432, the satellite antenna system 20 is automatically moved to adjust the horizontal orientation through the horizontal driving unit 41 and to adjust the inclination angle through the vertical driving unit 42 between the operation position and the folded position. In particularly, the user is able to remotely control the satellite antenna system 20 between the operation position and the folded position via the wireless controller 431 without climbing up to the roof of the vehicle.

Accordingly, the wireless controller 432 contains a particular serial number address to remotely control the control board 433. Therefore, even though two systems of the present invention are located side-by-side, the wireless controller 432 of one system will not be able to wirelessly control another system.

Figure 6:
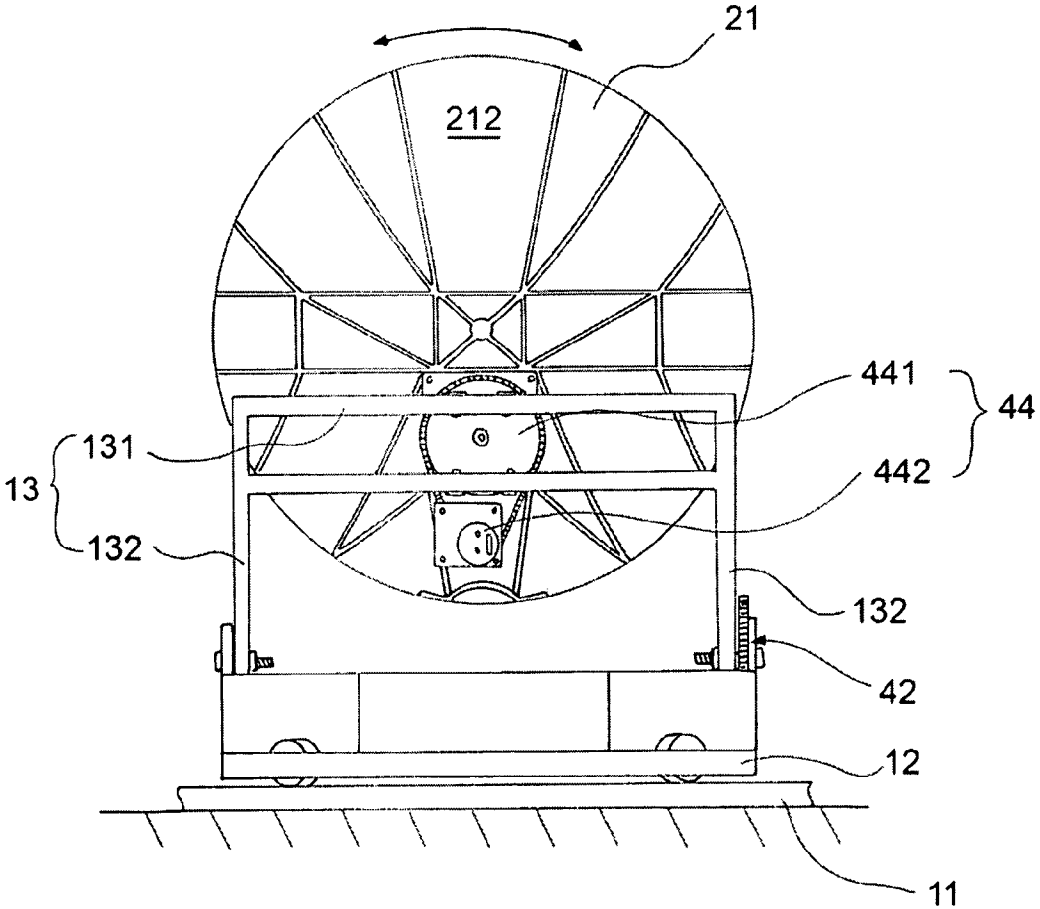
FIG. 6 is a rear view of the parabolic reflector of the automatic satellite tracking system in accordance with the present invention, illustrating the skew servo skewing the parabolic reflector.

The automatic driving mechanism 40 further comprises a skew adjusting unit 44 for automatically skewing the satellite antenna system 20 to correct an alignment of the parabolic reflector 21 with the satellite. As shown in FIG. 6, the skew adjusting unit 44 comprises a skew sprocket 441 mounted at the convex mounting side 212 of the parabolic reflector 21 and a skew servo 442 driving the skew sprocket 441 to rotate so as to rotate the parabolic reflector 21 with respect to the supporting frame 13. It is worth mentioning that the parabolic reflector 21 is rotated to obtain a required skew angle to align the parabolic reflector 21 to the corresponding satellite antenna.

Figure 7A:
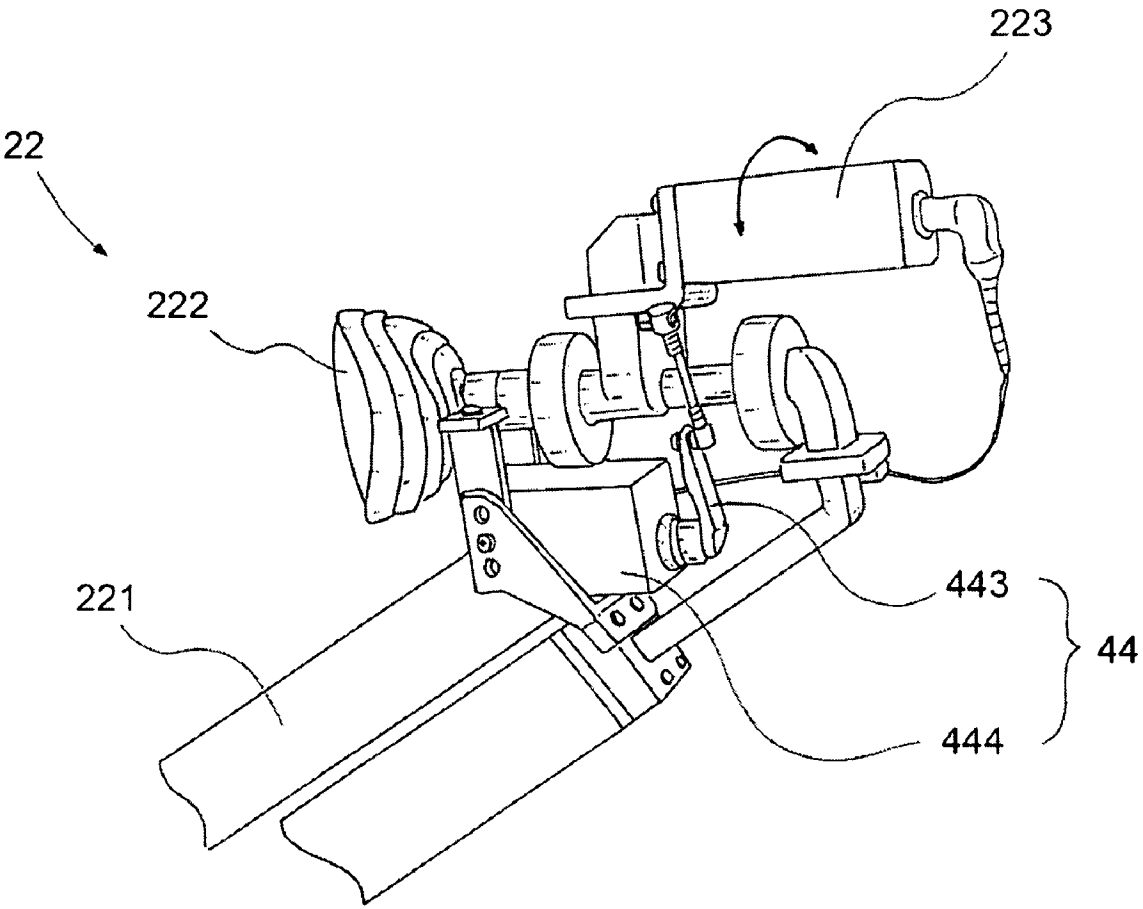
FIGS. 7A and 7B are perspective views illustrating the fine-skew adjustment of the automatic satellite tracking system in accordance with the present invention.
Figure 7B:
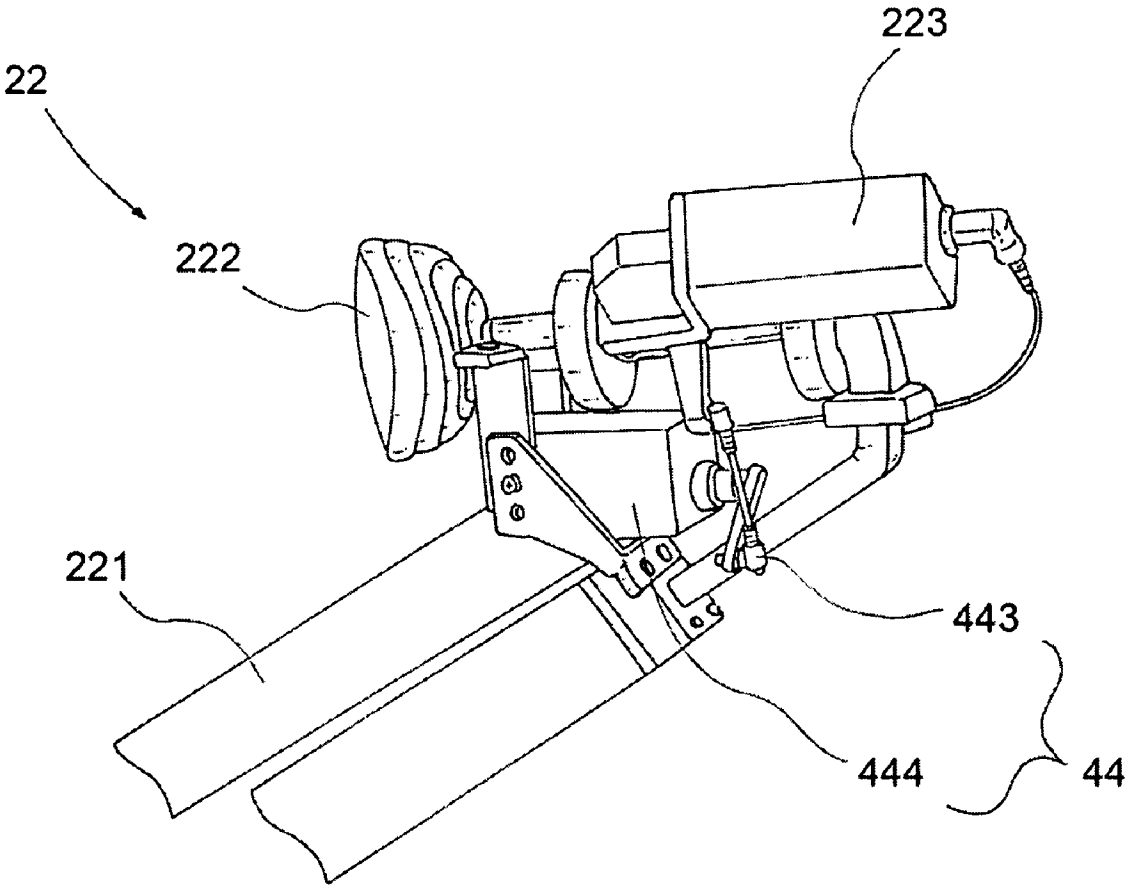

The skew adjusting unit 44 further comprises a skew adjusting arm 443 pivotally extended from the skew adjuster 223 of the feedhorn device 22 and a waveguide servo 444 driving the skew adjuster 223 to rotate through the skew adjusting arm 443 to automatically fine-adjust the skew to "null" out the cross polarized transponder from the satellite, as shown in FIGS. 7A and 7B. Accordingly, the waveguide servo 444 is supported at the pivot arm 221 to drive the skew adjuster 223 to rotate with respect to the pivot arm 221.

According to the preferred embodiment, the skew servo 442 and the waveguide servo 444 are electrically coupled with the slip ring assembly 431 and are automatically controlled by the control board 433.

As shown in FIG. 8, the automatic satellite tracking system further comprises an automatic satellite tracker 50 for automatically targeting the satellite antenna system 20 to the satellite through the automatic driving mechanism 40. Once the satellite antenna system 20 is set into automatic satellite acquisition operation, the automatic satellite tracker 50 will assist the satellite antenna system 20 to search for the correct satellite.

The automatic satellite tracker 50 comprises a signal level reader 51 communicating with the parabolic reflector 21 for reading a strength of the satellite signal from the satellite and a tracking processor 52 which is operatively linked to the automatic driving mechanism 40 and is arranged when the satellite antenna system 20 is moved at the operation position, the automatic driving mechanism 40 is activated to automatically adjust the parabolic reflector 21 until an optimized strength of the satellite signal is read by the signal level reader 51.

According to the preferred embodiment, the automatic satellite tracker 50 is incorporated with the automatic driving mechanism 40. The satellite antenna system 20 is rotated to adjust the horizontal orientation of the satellite antenna system 20 through via the horizontal driving unit 41 for searching the satellite signal at the horizontal direction. The satellite antenna system 20 is pivotally moved to adjust the inclination angle of the satellite antenna system 20 through via the vertical driving unit 42 for searching the satellite signal at the elevation direction. The parabolic reflector 21 of the satellite antenna system 20 is rotated to adjust the skew angle of the parabolic reflector 21 through via the skew servo 442 of the skew adjusting unit 44. The fine skew adjuster 223 is rotated via the waveguide servo 444. The above movements of the satellite antenna system 20 are automatically controlled by the automatic driving mechanism 40 to automatically target the satellite antenna system 20 to the satellite through the automatic satellite tracker 50. The user is able to operate the wireless controller 432 to wirelessly operate the satellite antenna system 20 from the folded position to the operation position, and to wirelessly activate the automatic satellite tracker 50 until the satellite antenna system 20 precisely targets to the corresponding satellite. In other words, the tracking system of the present invention is fully automatic. The wireless controller 432 is used to deploy the system into auto-tracking mode and conversely to store the tracking system so that the system can be transported down the highway. The user will not have control over the dish alignment manually. If the satellite cannot be acquired due to an obstacle in the path, the system will return to its folded position.

As shown in FIG. 8, the automatic satellite tracking system further comprises an Internet communication unit 60 communicatively linked to the satellite antenna system 20 for transmitting and receiving Internet satellite signal, wherein the Internet communication unit 60 comprises a modem module 61 modifying the satellite signal into an Internet signal, and a wireless transceiver 62 wirelessly transmitting and receiving the Internet signal. Therefore, the user is able to wirelessly link the computer to the wireless transceiver 62 for Internet accessing. Accordingly, the LNB and ODU are communicatively linked to the modem module 61 such that the modem module 61 will modify the signal received from the LNB and the signal transmitted by the ODU. Preferably, the user can wirelessly link the computer to the wireless transceiver 62 through "WiFi" to eliminate the Internet cabling into the vehicle.

As shown in FIG. 8, all electronic components of the system are concealed in an electronic enclosure 70. Accordingly, the electronic enclosure 70 is mounted on the rotational frame 12 wherein the slip ring assembly 431, the signal reader 51, the modem module 61, the wireless transceiver 62, the DC power converter, and the control board 433 with on board Radio Frequency transceiver for the wireless controller 432 are received in the electronic enclosure 70. A cooling device, such as a cooling fan and Peltier Module, is mounted at the wall of the electronic enclosure 70 for cooling down the electronic components. Accordingly, the wireless controller 432 will report not only the status of the system but also the electronic operating temperature within the electronic enclosure 70. The on board control electronic controls the cooling by sensing the enclosure temperature and pulse width modulating the cooling system. It is worth mentioning that all the electronic components are preset in the electronic enclosure 70 so that no electric wiring of the present invention is required for installation. In addition, since the electronic enclosure 70 is mounted on the rotation frame 12, the electronic enclosure 70 with all components therein will be rotated in responsive to the rotation of the rotation frame 12.

The installation of the present invention is extremely easy that the user is able to self-install the system on the roof of the vehicle. Accordingly, the user simply mounts the roof frame 10 on the roof of the vehicle and runs the cable under the roof frame 10 from the slip ring assembly 431 to the refrigerator vent so as to electrically couple with the 12 Volt power source of the vehicle. Then, the installation of the system is completed. For operating the system, the user is able to remotely switch on the system to its operation position so that the system will automatically track the corresponding satellite. For traveling, the user can remotely switch off the system to its folded position so that the system will automatically fold the parabolic reflector 21 to the roof of the vehicle to obtain an extremely low profile with low wind resistance.

According to the preferred embodiment, the tracking process of the system is described as the following. Upon deployment, the parabolic reflector 21 is pivotally lifted from facing down on the roof of the vehicle up to an elevation higher than the operating elevation level. The skew angle (the angle needed to match the polarized angle of the satellite antenna system 20) and elevation are derived from a "lookup table" which is used in conjunction with a GPS receiver to locate the latitude and longitude location of the system. The skew angle of the parabolic reflector 21 is actuated based on the look up table. The system then begins panning horizontally looking for the satellite signals of any kind through the rotational movement of the rotation frame 12. If the satellite antenna system 20 does not find any satellite signal after a full revolution of the rotational frame 12, the supporting frame 13 will pivotally lower down the satellite antenna system 20 toward the horizon with a relatively small degree of the inclination angle and the panning process continues. This process continues until the string of satellites is found which are at the equator. Then the process starts whereby the system starts searching for the correct satellite. Once the correct satellite is found, the system optimizes on the correct satellite and then switches in a filter which allows only a cross polarized transponder through the system. The system then actuates the fine skew (at the LNB) to minimize the cross pole signal. The filter is then switched out and the system is normalized and ready for Internet communications. If the satellite signal drops below a specified level, the system will automatically re-peak on the correct satellite.

Accordingly, the automatic satellite tracking system is shown to be incorporated with the recreational vehicle to illustrate the best mode of the present invention, in which the parabolic reflector 21 is folded flat on the roof of the recreational vehicle. However, it would have been obvious that the automatic satellite tracking system can be incorporated with the boats, trucks, cars, residential, industrial and commercial buildings, and trains for receiving satellite signal from the corresponding satellite (when stationary). It is worth mentioning that only one cable is required for electrically connecting the slip ring assembly 431 to the power source. Since the installation of the present invention is extremely easy and the system of the present invention provides an automatic tracking feature, the user is able to self-install onto the fixed surface without employing any experienced technician. Therefore, the automatic satellite tracking system can be a substitution of the conventional fixed satellite dish antenna for use in home to connect to the Internet signal via satellite.

While the embodiments and alternatives of the present invention have been shown and described, it will be apparent to one skilled in the art that various other changes and modifications can be made without departing from the spirit and scope of the present invention.

What is claimed is:

1. A satellite tracking system for tracking a geo-synchronous satellite, comprising:

a roof frame which comprises a mounting base adapted for securely mounting on a roof of a vehicle, a rotational frame supported on said mounting base in which said rotational frame is adapted to be 360° rotated on said mounting base, and a supporting frame pivotally coupled with a pivot edge of said rotational frame;

a satellite antenna system which comprises a parabolic reflector securely coupled with said supporting frame for gathering satellite signal and reflecting said satellite signal to a feed horn of said parabolic reflector, and a feedhorn device pivotally extended to said feed horn of said parabolic reflector, wherein said satellite antenna system is adapted for being folded between an operation position and a folded position, wherein at said operation position, said rotational frame is rotated on said mounting base to adjust a horizontal orientation of said parabolic reflector above said mounting base, wherein said supporting frame is pivotally moved to lift up said parabolic reflector at a predetermined inclination angle until said parabolic reflector aligns with said satellite for receiving said satellite signal, wherein at said folded position, said rotational frame is rotated on said mounting base to adjust said horizontal orientation of said parabolic reflector away from said mounting base, wherein said supporting frame is pivotally moved away from said mounting base to drop down said parabolic reflector until said parabolic reflector faces downwardly to said roof of said vehicle to conceal said feedhorn device between said parabolic reflector and said roof of said vehicle, such that said satellite antenna system provides a relatively low profile at said folded position when said vehicle travels; and an automatic driving mechanism for automatically operating said satellite antenna system between said operation position and said folded position, wherein said automatic driving mechanism comprises:

a horizontal driving unit driving said rotational frame to be rotated on said mounting base to controllably adjust said horizontal orientation of said parabolic reflector in responsive to the direction of said satellite, wherein said horizontal driving unit comprises a horizontal servo operatively supported at said rotational frame to drive said rotational frame being 360° rotated on said mounting base;

a vertical driving unit pivotally driving said supporting frame to controllably adjust said inclination angle of said parabolic reflector in responsive to the direction of said satellite, wherein said vertical driving unit comprises a vertical servo operatively connected to said supporting frame to controllably elevate and lower said parabolic reflector with respect to said rotational frame; and a control module operatively linked to said horizontal and vertical driving units to automatically move said satellite antenna system between said operation position and said folded position.

2. The satellite tracking system of claim 1 wherein said automatic driving mechanism further comprises a skew adjusting unit for automatically skewing said satellite antenna system to correct an alignment of said parabolic reflector with said satellite, wherein said skew adjusting unit comprises a skew servo driving said parabolic reflector to rotate with respect to said supporting frame to obtain a required skew angle align said parabolic reflector to said satellite.

3. The satellite tracking system, as recited in claim 2, wherein said skew adjusting unit further comprises a waveguide servo coupling with said feedhorn device to automatically fine-adjust the skew to null out the cross polarized transponder from said satellite.

4. The satellite tracking system of claim 3 wherein said vertical driving unit further comprises a first sprocket coupling with said rotational frame and being driven to rotate by said vertical servo, a second sprocket coupling with said supporting frame, and an endless transmission chain coupling between said first and second sprockets in such a manner that when said first sprocket is rotated, said second sprocket is driven to rotate through said endless transmission chain to pivotally move said supporting frame for adjusting said inclination angle of said parabolic reflector.

5. The satellite tracking system of claim 4 wherein said horizontal driving unit further comprises a plurality of supporting wheels spacedly mounted at said rotational frame, wherein said horizontal servo is operatively coupled with one of said supporting wheels to drive said corresponding supporting wheel to rotationally turn said rotational frame on said mounting base so as to controllably adjust said horizontal orientation of said parabolic reflector.

6. The satellite tracking system of claim 5 wherein said control module comprises a slip ring assembly adapted for electrically coupling with a power source of said vehicle, a control board electrically connected with said slip ring assembly to control said horizontal and vertical driving units, and a wireless controller wirelessly communicating with said control board to operatively move said satellite antenna system between said operation position and said folded position in a wireless controlling manner.

7. The satellite tracking system of claim 6 further comprising an automatic satellite tracker for automatically targeting said satellite antenna system to said satellite, wherein said automatic satellite tracker comprises a signal level reader communicating with said parabolic reflector for reading a strength of said satellite signal from said satellite and a tracking processor which is operatively linked to said automatic driving mechanism and is arranged when said satellite antenna system is moved at said operation position, said automatic driving mechanism is activated to automatically adjust said parabolic reflector until an optimized strength of said satellite signal is read by said signal level reader.

8. The satellite tracking system of claim 7 wherein said feedhorn device comprises a pivot arm pivotally extended from said parabolic reflector, a feed horn assembly coupling with a free end of said pivot arm for receiving and transmitting said satellite signals through said parabolic reflector, and a skew adjuster communicatively linked to said feed horn assembly to skew signals of said feed horn assembly, wherein said waveguide servo drives said skew adjuster to rotate with respect to said pivot arm for signal polarity modification.

9. The satellite tracking system of claim 8 further comprising an Internet communication unit communicatively linked to said satellite antenna system for transmitting Internet satellite signal, wherein said Internet communication unit comprises a modem module modifying said satellite signal into an Internet signal, and a wireless transceiver wirelessly transmitting and receiving said Internet signal to a computer of the user.

10. The satellite tracking system of claim 9 further comprising an electronic enclosure supported on said rotational frame, wherein said Internet communication unit, said slip ring assembly and electronic components of said satellite antenna system are protectively concealed in said electronic enclosure.

11. The satellite tracking system of claim 1 wherein said vertical driving unit further comprises a first sprocket coupling with said rotational frame and being driven to rotate by said vertical servo, a second sprocket coupling with said supporting frame, and an endless transmission chain coupling between said first and second sprockets in such a manner that when said first sprocket is rotated, said second sprocket is driven to rotate through said endless transmission chain to pivotally move said supporting frame for adjusting said inclination angle of said parabolic reflector.

12. The satellite tracking system of claim 1 wherein said horizontal driving unit further comprises a plurality of supporting wheels spacedly mounted at said rotational frame, wherein said horizontal servo is operatively coupled with one of said supporting wheels to drive said corresponding supporting wheel to rotationally turn said rotational frame on said mounting base so as to controllably adjust said horizontal orientation of said parabolic reflector.

13. The satellite tracking system of claim 1 wherein said control module comprises a slip ring assembly adapted for electrically coupling with a power source of said vehicle, a control board electrically connected with said slip ring assembly to control said horizontal and vertical driving units, and a wireless controller wirelessly communicating with said control board to operatively move said satellite antenna system between said operation position and said folded position in a wireless controlling manner.

14. The satellite tracking system of claim 1 further comprising an automatic satellite tracker for automatically targeting said satellite antenna system to said satellite, wherein said automatic satellite tracker comprises a signal level reader communicating with said parabolic reflector for reading a strength of said satellite signal from said satellite and a tracking processor which is operatively linked to said automatic driving mechanism and is arranged when said satellite antenna system is moved at said operation position, said automatic driving mechanism is activated to automatically adjust said parabolic reflector until an optimized strength of said satellite signal is read by said signal level reader.

15. The satellite tracking system of claim 3 further comprising an automatic satellite tracker for automatically targeting said satellite antenna system to said satellite, wherein said automatic satellite tracker comprises a signal level reader communicating with said parabolic reflector for reading a strength of said satellite signal from said satellite and a tracking processor which is operatively linked to said automatic driving mechanism and is arranged when said satellite antenna system is moved at said operation position, said automatic driving mechanism is activated to automatically adjust said parabolic reflector until an optimized strength of said satellite signal is read by said signal level reader.

16. The satellite tracking system of claim 3 wherein said feedhorn device comprises a pivot arm pivotally extended from said parabolic reflector, a feed horn assembly coupling with a free end of said pivot arm for receiving and transmitting said satellite signals through said parabolic reflector, and a skew adjuster communicatively linked to said feed horn assembly to skew signals of said feed horn assembly, wherein said waveguide servo drives said skew adjuster to rotate with respect to said pivot arm for signal polarity modification.

17. The satellite tracking system of claim 3 further comprising an Internet communication unit communicatively linked to said satellite antenna system for transmitting Internet satellite signal, wherein said Internet communication unit comprises a modem module modifying said satellite signal into an Internet signal, and a wireless transceiver wirelessly transmitting and receiving said Internet signal to a computer of the user.

18. The satellite tracking system of claim 6 further comprising an electronic enclosure supported on said rotational frame, wherein said slip ring assembly, said control board, and electronic components of said satellite antenna system are protectively concealed in said electronic enclosure.

19. A satellite tracking system for tracking a geo-synchronous satellite, comprising:

a roof frame which comprises a mounting base adapted for securely mounting on a roof of a vehicle, a rotational frame supported on said mounting base in which said rotational frame is adapted to be 360° rotated on said mounting base, and a supporting frame pivotally coupled with a pivot edge of said rotational frame;

a satellite antenna system which comprises a parabolic reflector securely coupled with said supporting frame for gathering satellite signal and reflecting said satellite signal to a feed horn of said parabolic reflector, and a feedhorn device pivotally extended to said feed horn of said parabolic reflector, wherein said satellite antenna system is adapted for being folded between an operation position and a folded position, wherein at said operation position, said rotational frame is rotated on said mounting base to adjust a horizontal orientation of said parabolic reflector above said mounting base, wherein said supporting frame is pivotally moved to lift up said parabolic reflector at a predetermined inclination angle until said parabolic reflector aligns with said satellite for receiving said satellite signal, wherein at said folded position, said rotational frame is rotated on said mounting base to adjust said horizontal orientation of said parabolic reflector away from said mounting base, wherein said supporting frame is pivotally moved away from said mounting base to drop down said parabolic reflector until said parabolic reflector faces downwardly to said roof of said vehicle to conceal said feedhorn device between said parabolic reflector and said roof of said vehicle, such that said satellite antenna system provides a relatively low profile at said folded position when said vehicle travels, wherein said feedhorn device comprises a pivot arm pivotally extended from said parabolic reflector, a feed horn assembly coupling with a free end of said pivot arm for receiving and transmitting said satellite signals through said parabolic reflector, and a skew adjuster communicatively linked to said feed horn assembly to skew signals of said feed horn assembly.

* * * * *